US010220989B2

(12) United States Patent
Painchaud et al.

(10) Patent No.: US 10,220,989 B2
(45) Date of Patent: Mar. 5, 2019

(54) LIQUID DISPENSING NOZZLE AND DEVICE COMPRISING A CAP

(71) Applicant: Nemera La Verpillière S.A.S., La Verpilliere (FR)

(72) Inventors: Gaëtan Painchaud, Francheville (FR); Benjamin Quaglia, Lyons (FR)

(73) Assignee: Nemera La Verpillière (FR)

( * ) Notice: Subject to any disclaimer, the term of this patent is extended or adjusted under 35 U.S.C. 154(b) by 0 days.

(21) Appl. No.: 15/994,329

(22) Filed: May 31, 2018

(65) Prior Publication Data

US 2018/0346211 A1 Dec. 6, 2018

(30) Foreign Application Priority Data

May 31, 2017 (FR) ..... 17 54837

(51) Int. Cl.
*B65D 47/18* (2006.01)
*B65D 47/20* (2006.01)
*B05B 11/04* (2006.01)

(52) U.S. Cl.
CPC ..... *B65D 47/18* (2013.01); *B05B 11/04* (2013.01); *B65D 47/2081* (2013.01)

(58) Field of Classification Search
CPC .... B65D 47/00; B65D 47/18; B65D 47/2081; B65D 47/2068; B65D 51/24; B65D 51/1616; B65D 41/32; B05B 11/00; B05B 11/02; B05B 11/04
USPC ..... 222/153.1, 153.01, 153.02; 220/254.2, 220/255, 255.11; 215/217–220
See application file for complete search history.

(56) References Cited

U.S. PATENT DOCUMENTS 3,795,337 A * 3/1974 Nozawa ..... B65D 50/041 215/219
5,197,616 A 3/1993 Buono
6,085,920 A * 7/2000 Moretti ..... B65D 41/34 215/220
8,857,638 B2 * 10/2014 Brozell ..... B65D 50/041 215/219

(Continued)

FOREIGN PATENT DOCUMENTS

BE 690559 A 5/1967
EP 2687198 A2 1/2014

(Continued)

*Primary Examiner* — Lien Ngo
(74) *Attorney, Agent, or Firm* — St. Onge Steward Johnston & Reens, LLC

(57) ABSTRACT

A liquid dispensing nozzle including a liquid dispensing opening and a removable cap designed to cover the recess. The cap has an exterior envelope and an interior envelope that are coaxial, mounted mobile relative to one another in an axial direction and each have a sealing surface and able to assume a before first use storage configuration, in which the sealing surfaces of the exterior envelope and the interior envelope are in hermetically sealed contact with one another. The cap further includes a safety envelope mounted mobile relative to the exterior envelope between a configuration for unscrewing the cap when a bearing force exerted on the safety envelope has an intensity greater than a predetermined threshold, and a safety configuration when the bearing force has an intensity less than a predetermined threshold or when no bearing force is exerted on the safety envelope.

16 Claims, 3 Drawing Sheets

(56) References Cited

U.S. PATENT DOCUMENTS

| | | | | |
|---|---|---|---|---|
| 9,592,934 | B2 * | 3/2017 | Painchaud | B05B 11/00 |
| 2002/0195460 | A1 | 12/2002 | Kapsa et al. | |
| 2015/0166224 | A1 * | 6/2015 | Greiner-Perth | B65D 47/2068 222/153.06 |
| 2015/0166229 | A1 * | 6/2015 | Wochele | B65D 41/48 222/153.05 |
| 2017/0129662 | A1 * | 5/2017 | Decock | B05B 11/0032 |

FOREIGN PATENT DOCUMENTS

| | | | |
|---|---|---|---|
| FR | 2997684 | A1 | 5/2014 |
| WO | 2013140069 | A1 | 9/2013 |
| WO | 2015140473 | A1 | 9/2015 |
| WO | WO 2016/204732 | A1 * | 12/2016 |

* cited by examiner

LIQUID DISPENSING NOZZLE AND DEVICE COMPRISING A CAP

FIELD OF THE INVENTION

The present invention concerns the technical field of dispensing liquids. It concerns in particular, but not exclusively, the field of dispensing liquids in the form of droplets or in the form of a spray, such as ophthalmic, nasal, buccal or auricular liquid.

BACKGROUND OF THE INVENTION

There has already been proposed in the document WO2013/140069, a liquid dispensing device comprising a reservoir and a dispensing nozzle provided with a removable cap. The cap described in the above document comprises two envelopes mobile relative to one another in order to be able to create an air passage allowing evaporation of residual liquid located at the level of the dispensing orifice. It is found that this cap is opened simply by unscrewing it, with the result that the liquid product contained in the reservoir becomes easily accessible via the dispensing nozzle. This presents a hazard for a young child who may, by manipulating the device, manage to open the cap and obtain access to the liquid product, which may cause their intoxication.

SUMMARY OF THE INVENTION

A particular object of the invention is to remedy these drawbacks by providing a liquid dispensing nozzle and device that are safer.

To this end the invention consists in a liquid dispensing nozzle comprising:

- a liquid dispensing opening,
- a removable cap designed to cover said opening, the cap comprising an exterior envelope and an interior envelope that are coaxial, mounted to be mobile relative to one another in an axial direction (A) of the nozzle and each have a sealing surface and are able to assume a before first use configuration, termed storage configuration, in which the sealing surfaces of the exterior envelope and the interior envelope are in hermetically sealed contact with one another,
- the cap further comprising a safety envelope mounted to be mobile relative to the exterior envelope between:
  - a configuration for unscrewing the cap when a bearing force exerted on the safety envelope has an intensity greater than a predetermined threshold, in which rotation in a first direction of the safety envelope drives rotation of the exterior envelope in the same first direction so as to be able to unscrew the cap;
  - a safety configuration when a bearing force exerted on the safety envelope has an intensity less than a predetermined threshold or when no force is exerted on the safety envelope, in which the safety envelope is configured to freewheel relative to the exterior envelope in the first direction, the safety configuration further corresponding to a configuration, distinct from the before first use configuration, and in which the respective sealing surfaces of the exterior envelope and the interior envelope are separated from one another so as to allow air to pass between them.

Thus there is proposed a nozzle in which the safety envelope, the exterior envelope and the interior envelope may advantageously adopt a configuration allowing air to pass between them whilst offering enhanced safety. In fact, a sufficiently high bearing force is required on the safety envelope to unscrew the cap. Unscrewing remains simple and intuitive for an adult whereas a child, who is not capable of turning while pressing or of pressing sufficiently firmly on the safety envelope, will find itself only in the safety configuration of the cap and will not be able to unscrew it. Said bearing force exerted on the cap is preferably, but not exclusively, an axial bearing force. Clearly, when the cap is in the unscrewing configuration, the safety envelope is driven in rotation, preferably by the user, in the first direction, which is preferably the anticlockwise direction, corresponding to the classic unscrewing direction. Thanks to the bearing force applied to the security envelope, the exterior envelope is also driven to turn in the same direction, which therefore allows unscrewing of the cap, where applicable via the interior envelope driven by the exterior envelope. Clearly the arrangement of the sealing surfaces enable a nozzle to be provided that is hermetically sealed prior to its first use. It is therefore possible to limit evaporation of the liquid contained in the nozzle during storage of the nozzle and contamination of the nozzle by dust or microorganisms during storage. After the first opening of the cap, that is to say when the cap is in a configuration other than the storage configuration, the sealing surfaces are no longer in hermetically sealed contact. Because of this, air is advantageously able to pass between the two surfaces and enable evaporation of the liquid when an evaporation path is created between the interior and the exterior of the cap. This makes it possible to prevent liquids stagnating at the dispensing opening of the nozzle, and therefore the growth of bacteria. It will be noted that the sealing surfaces are no longer in hermetically sealed contact in the safety configuration, and preferably also in the unscrewing configuration.

Clearly the arrangement of the sealing surfaces advantageously enables a residual liquid evaporation path to be produced, but that path is not systematically provided on the nozzle. In fact, although the sealing surfaces may on the one hand be in hermetically sealed contact with one another, and on the other hand separated from one another to allow air to pass between them, the existence of a residual liquid evaporation path may be an optional function of the nozzle. A cap of standard shape is therefore supplied, able to feature this function or not, for example according to whether the interior and/exterior envelopes have air passage orifices or not, so as to optimize the method of manufacture of the cap.

By "the safety envelope is configured to freewheel relative to the exterior envelope in the first direction" is meant that the safety envelope is able to turn freely relative to the exterior envelope in that direction, without being constrained to rotate with the exterior envelope. When the cap is in the safety configuration, the safety envelope is therefore configured to be driven in the first direction by the user, whilst the exterior and interior envelopes remain immobile on the dispensing nozzle. In other words, rotation in the first direction of the safety envelope does not have the effect of generating rotation of the interior envelope in the first direction. By "axial direction of the nozzle" is preferably meant the direction defined by a geometrical axis of the nozzle.

The safety envelope, the exterior envelope and the interior envelope are preferably three separate parts assembled to one another. A particularly beneficial advantage of using a safety envelope in addition to the exterior envelope and the interior envelope resides in the fact that a safety function may be offered as an option on an existing product. It is therefore optionally possible to improve a dispensing nozzle that already has a double envelope structure by adding an additional part to it, without modifying the structure of each envelope. This enables the design and the manufacture of the nozzle to be simplified.

The invention may further include one or more of the following features, separately or in combination.

- The safety envelope covers the exterior envelope entirely in the unscrewing configuration and preferably also in the storage configuration and in the safety configuration. By "the safety envelope covers the exterior envelope entirely" is meant that the exterior envelope is not accessible, and preferably not visible, to a user from the exterior of the nozzle. This enables the reliability and the safety of the nozzle to be improved.
- The safety envelope comprises a bottom and a cylindrical wall that comprises means for retaining the exterior envelope inside the safety envelope, the retaining means preferably being on an end of the cylindrical wall opposite the bottom and preferably further comprising a protuberance projecting from the interior surface of the cylindrical wall. The retaining means preferably allow relative axial movement in translation between the safety envelope and the exterior envelope without them being completely separated from one another.
- The safety envelope comprises drive means intended to cooperate with complementary drive means carried by the exterior envelope in order to drive the latter in rotation in the first direction in the unscrewing configuration.
- The drive means comprise a plurality of projections arranged at the periphery of a cylindrical wall of the safety envelope and the complementary drive means comprise a plurality of recesses, each projection being intended to come to bear against a recess in the unscrewing configuration. In other words, the drive means and the complementary drive means substantially form a gear train.
- The cap comprises return means between the safety envelope and the exterior envelope intended to inactivate the drive means relative to the complementary drive means when the cap is in the safety configuration; for example the safety envelope comprises a bottom and the return means comprise a flexible tongue projecting from the interior surface of the bottom of the safety envelope. The return means enable separation of the safety envelope from the exterior envelope so that the drive means are not in contact with the complementary drive means. By "inactivated" is meant that the movement of the drive means has no impact on the exterior envelope.
- The drive means and the complementary drive means are configured so that the exterior envelope and the interior envelope are constrained to rotate together in a second direction opposite the first direction in order to screw on the cap. The same drive means therefore effect both screwing on and unscrewing of the cap, which simplifies the structure and the manufacture of the nozzle.
- The cap comprises indicator means between the safety envelope and the exterior envelope configured to give the user tactile and/or sound feedback in the safety configuration, said indicator means comprising for example the flexible tongue intended to pass over detents carried by the exterior envelope. According to one particularly advantageous embodiment, the flexible tongue corresponds to the return means, which simplifies the structure and the manufacture of the nozzle.
- There is a residual liquid evaporation path between the opening and the exterior of the nozzle, the residual liquid evaporation path being blocked in the storage configuration and open in the safety configuration. It is advantageously also open in the unscrewing configuration. Clearly the opening of the residual liquid evaporation path is activated when the respective sealing surfaces of the exterior envelope and of the interior envelope are separated from one another to allow air to pass between them. The residual liquid is therefore in contact with the air outside the cap and is able to evaporate via the evaporation path once the cap is no longer in the storage configuration.
- The interior envelope comprises first locking means intended to cooperate with complementary first locking means carried by the exterior envelope in order to hold the sealing surfaces apart. The sealing surfaces are advantageously held apart in all configurations other than the storage configuration.
- The interior envelope comprises second locking means intended to cooperate with complementary second locking means carried by the exterior envelope in order for the interior envelope and the exterior envelope to be constrained to rotate together. These means advantageously make it possible to screw the cap onto a part of the nozzle during assembly of the nozzle.
- The cap comprises a residual liquid absorbing pad in the vicinity of the liquid dispensing opening. This pad is advantageously disposed downstream of the dispensing opening and enables a great amount of the residual liquid to be drained out of the dispensing opening.
- The cap comprises a protuberance intended to be in the immediate vicinity of and facing the opening when the cap is mounted on the nozzle, this protuberance having a shape for expelling the residual liquid configured to evacuate the residual liquid to the outside when the cap is mounted on the nozzle. Thanks to the presence of the shape for expelling the residual liquid produced on the removable cap, when the cap is mounted on the nozzle the expulsion shape situated in the immediate vicinity of and facing the liquid dispensing opening expels the greater part of the residual liquid present downstream of the dispensing opening, in particular toward the residual liquid absorbing pad, if any, disposed in the vicinity, that is to say that the residual liquid is evacuated to the exterior of the nozzle. The greater part of the residual liquid is therefore drained out of the dispensing opening.
- The cap includes on the exterior of the safety envelope raised or visual means indicating to the user how to go from the safety configuration to the unscrewing configuration. For example, these means may comprise a series of symbols such as arrows, text or digits indicating the order of the actions to be carried out.
- The cap comprises means for indicating that the cap is in a configuration other than the storage configuration, for example a slot in the safety envelope and in the exterior envelope enabling two zones of different colour of the interior envelope to be seen. The user is therefore easily informed whether the nozzle has already been opened or not.

The invention finally consists in a liquid dispensing device including a liquid dispensing nozzle as described above mounted on a reservoir.

BRIEF DESCRIPTION OF THE DRAWINGS

The invention will be better understood on reading the following description given by way of example only and with reference to the drawings, in which.

DETAILED DESCRIPTION OF THE INVENTION

Figure 1:
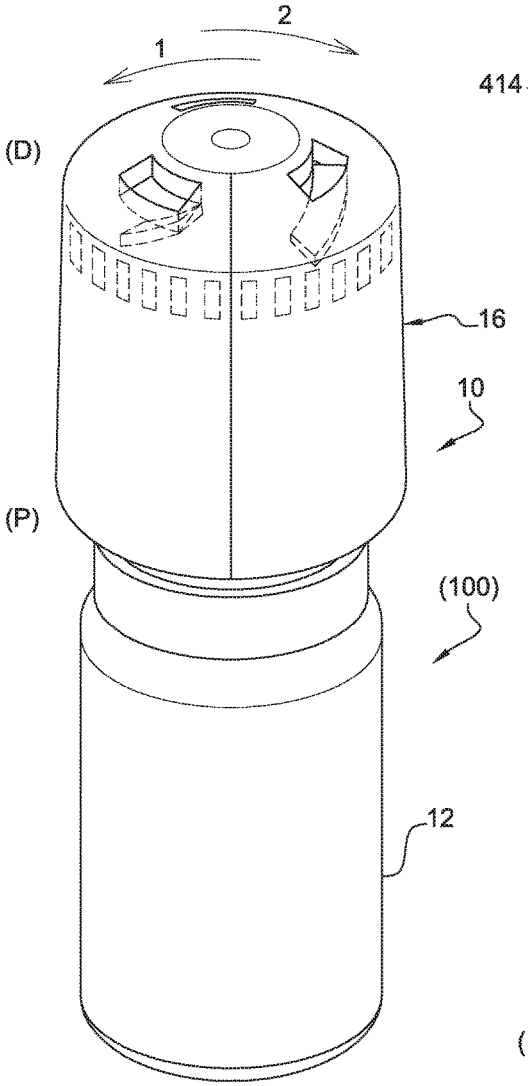
FIG. 1 is a perspective view of a dispensing device according to one embodiment comprising a dispensing nozzle with a cap provided with a safety envelope and mounted on the dispensing part, the dispensing nozzle being carried by a reservoir.
Figure 2:
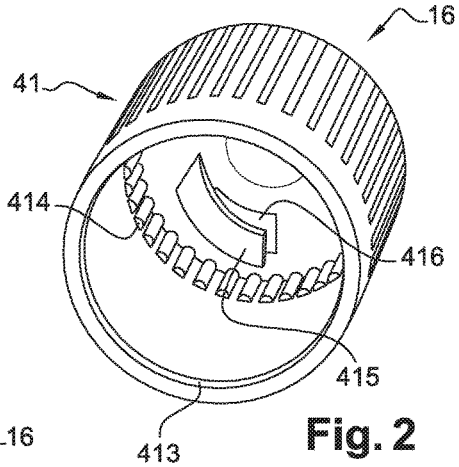
FIG. 2 is a perspective view of the interior of the safety envelope of the nozzle from FIG. 1.
Figure 3:
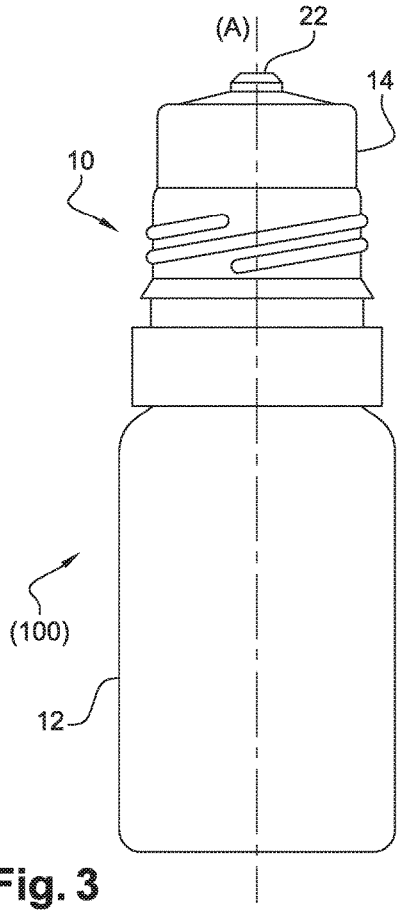
FIG. 3 is a side view of the dispensing device from FIG. 1 with the cap removed.

A device, as represented in FIG. 1 and designated by the reference 100, comprises a deformable reservoir 12 that is a storage reservoir for liquids, for example pharmaceutical liquids such as ophthalmic liquids, and a nozzle for dispensing liquid in droplet form. As can be seen in FIG. 3, the nozzle designated by the reference 10 comprises a dispensing part 14 including an opening 22 for dispensing the liquid (see FIG. 3) and intended to be mounted on the neck of the reservoir 12 by clipping, welding or screwing it on or by any other known technique. The nozzle 10 further comprises a removable cap 16 mounted by screwing it onto the dispensing part 14 and intended to cover the opening 22 when the nozzle 10 is not being used. The cap 16 has a proximal end (P) disposed on the side of the opening of the cap 16 and an opposite distal end (D) (see FIG. 1).

The cap 16 comprises an exterior envelope 42, an interior envelope 44 and a safety envelope 41. These safety, exterior and interior envelopes 41, 42, 44 are coaxial and mounted to be mobile relative to one another in an axial direction (A) of the nozzle 10 (see FIG. 3). The axial direction (A) of the nozzle 10 is defined here by the geometrical axis of the reservoir 12. The safety, exterior and interior envelopes 41, 42, 44 are mounted to be mobile along that geometrical axis, either away from one another or toward one another. Thanks to this mobility, the safety, exterior and interior envelopes 41, 42, 44 are able to define in particular three distinct configurations of the nozzle 10, namely a configuration prior to first use, termed a storage configuration, a configuration for unscrewing the cap 16 and a safety configuration, all which are described in detail hereinafter.

Figure 4:
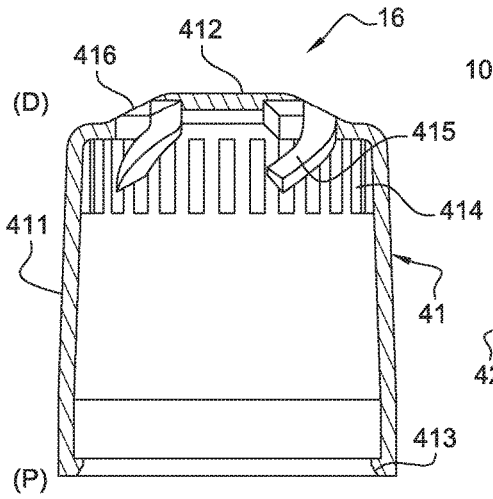
FIG. 4 is a side view and partially by transparency of the safety envelope of the nozzle from FIG. 1.

As shown in FIG. 4, the safety envelope 41 comprises a bottom 412 and a substantially cylindrical wall 411. The wall 411 has at its interior periphery and at its distal end (D) drive means 414, here in the form of a plurality of projections 414 circumferentially distributed on the interior surface of the wall 411. The bottom 412 moreover comprises return means 415, shown in this example in the form of flexible tongues 415, three in number in this instance, extending from the bottom 412 in a substantially helicoidal direction. The bottom 412 further includes air passage orifices 416 each in the vicinity of a flexible tongue 415. The safety envelope 41 also comprises retaining means 413 disposed inside and in the vicinity of the proximal end (P) of the safety envelope 41. In this example the retaining means 413 comprise an annular interior rim 413 projecting on the interior surface of the wall 411, formed directly at the proximal end (P) of the safety envelope 41.

Figure 7:
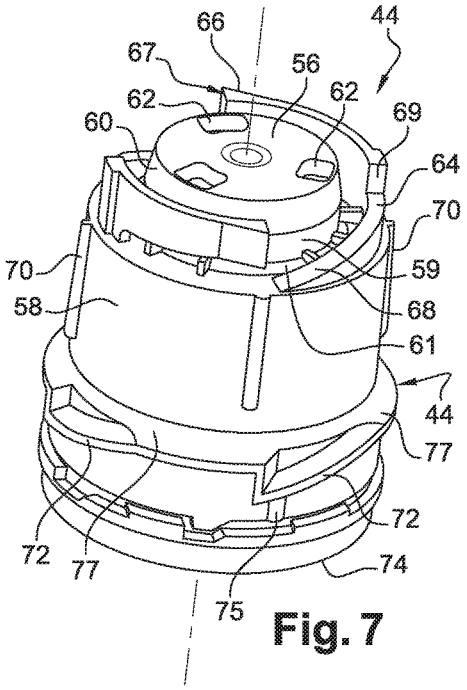
FIG. 7 is a perspective view of the exterior of the interior envelope of the nozzle from FIG. 1.

The interior envelope 44 is shown more particularly in FIG. 7. It comprises a ceiling 56, a first skirt 58 and a second skirt 59 (see FIG. 8) of substantially cylindrical shape interconnected by a plate 61. The second skirt 59 includes a sealing surface 60. The ceiling 56 is delimited by a cylindrical surface forming the sealing surface 60 connecting it to the second skirt 59. The ceiling 56 comprises air passage orifices 62, three in number in this example. The interior envelope 44 further comprises, at the proximal end (P) a frangible ring 74. The interior envelope 44 further includes rims 77 spaced from one another by ramps 72. Hard points 75, four in number in this instance, are arranged between a ramp 72 and the frangible rim 74.

The interior envelope 44 further comprises first locking means 64, 66, 68 for locking the exterior envelope 42 (see FIG. 7). Those means comprise two guide slopes 68 spaced from one another and extending from the first skirt 58 in the axial direction (A). The guide slope 68 includes at least one end of travel abutment 69 formed here by a face lying in an axial plane, that is to say a plane parallel to the geometrical axis (A) of the nozzle 10 and preferably containing that axis (A). The locking means further comprise two elastic lugs 66, each connected to a guide slope 68 by a flat zone 64. Each elastic lug 66 carries a locking face 67. The interior envelope 44 also includes positioning edges 70, four in number in this instance, projecting radially from the first skirt 58 and extending longitudinally. The positioning edges 70 enable the cap 16 to be screwed onto the dispensing part 14 of the nozzle 10. To be more precise, the positioning edges 70 are examples of second locking means intended to cooperate with complementary second locking means 86 carried by the exterior envelope 42 so that the interior envelope 44 and the exterior envelope 42 are constrained to rotate together, as described hereinafter.

Figure 5:
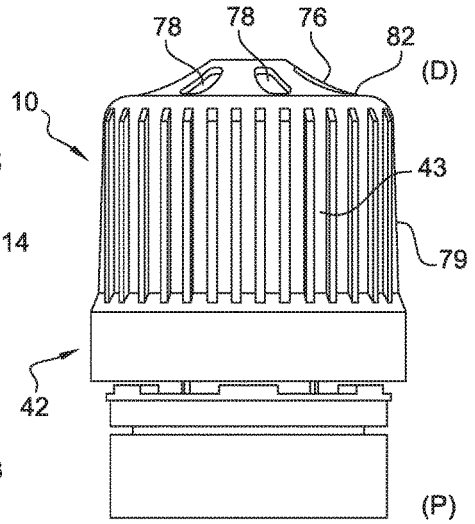
FIG. 5 is a side view of the nozzle from FIG. 1 with the safety envelope removed.
Figure 6:
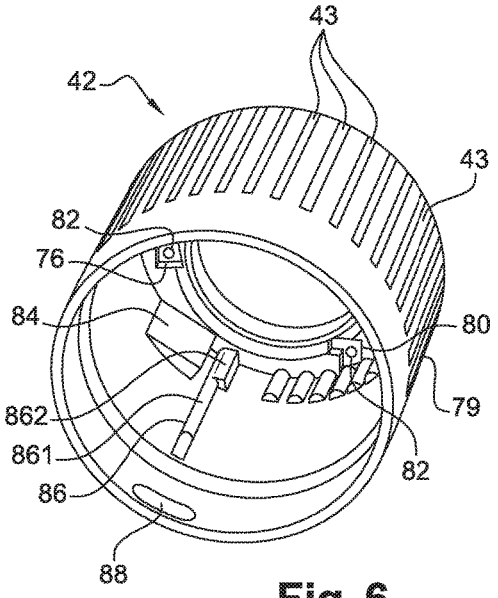
FIG. 6 is a perspective view of the interior of the exterior envelope of the nozzle from FIG. 1.

As shown in FIGS. 5 and 6, the exterior envelope 42 comprises a bottom 76 and a peripheral wall 79 of substantially cylindrical shape. The bottom 76 is of circular shape, substantially conical shape in this example. The exterior envelope 42 further includes a sealing skirt 80 projecting from the interior surface of the bottom 76, disposed inside and here having an annular shape coaxial with the peripheral wall 79. The sealing skirt 80 has at its proximal end a sealing surface. The bottom 76 further includes hollow detents 78 circumferentially distributed on the external surface (FIG. 5). Also in this example the bottom 76 includes air passage orifices 82 (FIG. 6) formed radially on the bottom 76 between the sealing skirt 80 and the peripheral wall 79. The exterior envelope 42 further comprises a plurality of gadroons 88 projecting from the interior surface of the peripheral wall 79 at the proximal end (P) of the exterior envelope 42. The exterior envelope 42 includes protuberances 86, two in number in this instance, projecting radially from the interior surface of the peripheral wall 79. The protuberance 86 includes an axial part 861 elongate in the axial direction (A) and, on the distal side (D) of that axial part 861, a radial part 862 projecting radially from the axial part 861. The protuberances 86 are intended to cooperate with the positioning edges 70 of the interior envelope 44. The exterior envelope 42 also comprises locking means 84 complementary to the locking means 64, 66, 68, taking the form of a prism 84 projecting radially from the internal surface of the peripheral wall 79.

In order to cooperate with the safety envelope 41, the exterior envelope 42 further comprises complementary drive means 43 taking the form of a plurality of recesses 43 circumferentially distributed in the form of grooves extending in the axial direction (A) on the external periphery of the peripheral wall 79 (FIGS. 5, 6).

The assembly and the operation of the nozzle 10 are described next.

During assembly of the removable cap 16, the exterior envelope 42 is placed over the interior envelope 44 with the axial part 861 of the protuberance 86 positioned in contact with the positioning edge 70, the radial part 862 of the protuberance 86 therefore being situated at the bottom of the guide slope 68. The prism 84 then bears against the elastic lug 66 with the result that the latter is slightly deformed. The sealing skirt 80 of the exterior envelope 42 is then mounted on the second skirt 59 of the interior envelope 44 with a tight fit. The gadroons 88 of the exterior envelope 42 cooperate with the ramps 72 of the interior envelope 44 in order to immobilize the exterior envelope 42 in translation in the axial direction (A) relative to the interior envelope 44. The gadroons 88 moreover cooperate with the hard points 75 in order to prevent the exterior envelope 42 from rotating relative to the interior envelope 44.

Figure 8:
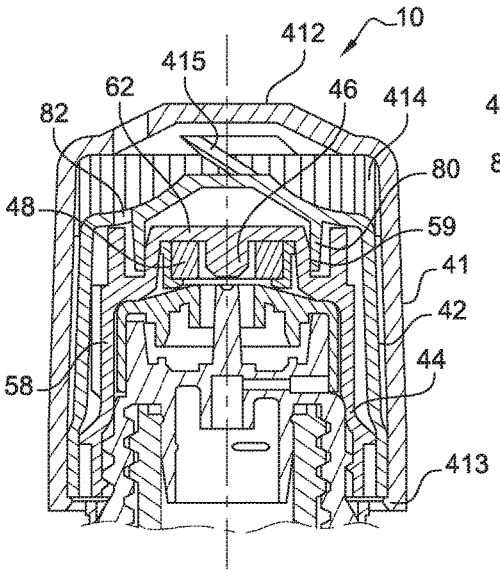
FIG. 8 is a view in section of the nozzle from FIG. 1 in a storage configuration.

The safety envelope 41 is then mounted around the exterior envelope 42, the flexible tongues 415 then bearing against the bottom 76 of the exterior envelope 42. The interior rim 413 of the safety envelope 41 covers the proximal end (P) of the exterior envelope 42 and is pressed against it with the result that the security and exterior envelopes 41, 42 are fastened together in the axial direction (A) in the storage configuration, as can be seen in FIG. 8. The safety envelope 41 is configured to cover the exterior envelope 42 completely so that the latter is preferably neither visible nor accessible from the outside of the nozzle 10. Once the safety, exterior and interior envelopes 41, 42, 44 have been assembled, the cap 16 is ready to be mounted by screwing it onto the dispensing part 14. Once the reservoir 12 has been filled with the liquid to be dispensed, the nozzle 10, including the cap 16, is mounted on the neck of the reservoir 12, for example by screwing it on, clipping it on or by any other known technique. The nozzle 10 is in the storage configuration and is ready to be used.

The storage configuration of the nozzle 10 is shown in FIG. 8. The two sealing surfaces defined by the second skirt 59 and by the sealing skirt 80 of the exterior envelope 42 are in hermetically sealed contact with one another with the result that there is no communication between the air passage orifices 62 of the interior envelope 44 and the air passage orifices 416 of the safety envelope 41.

Figure 9:
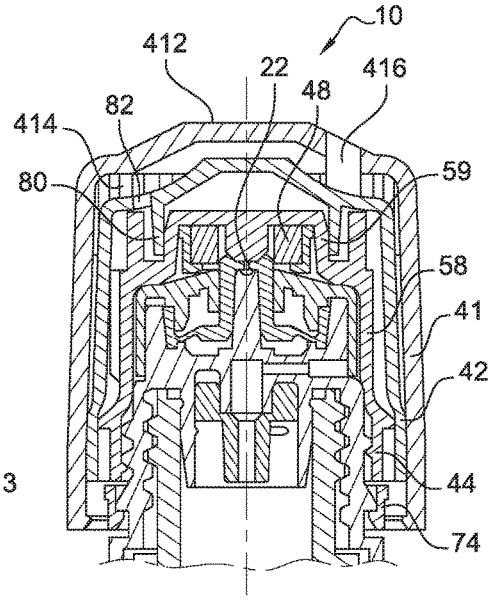
FIG. 9 is a sectional view of the nozzle from FIG. 1 after the first opening thereof.

The user, preferably an adult, can then open the cap 16 by applying a force to it, an axial bearing force in the present instance, with an intensity greater than a predetermined threshold. This bearing force then places the cap 16 in the unscrewing configuration. On first use, the user unscrews the cap 16. They grip the safety envelope 41 in one hand and the reservoir 12 in the other hand. They depress the safety envelope 41 against the return force of the flexible tongues 415. The safety envelope 41 is then moved in the axial direction (A) toward the exterior envelope 42 and the drive means 414 of the safety envelope 41 are positioned at the same level as the complementary drive means 43 and mesh with the latter, as can be seen in FIG. 9. Because of this, the user causes the safety envelope 41 and the exterior envelope 42 to turn at the same time in a first direction 1 that corresponds to the anticlockwise direction, as can be seen in FIG. 1. The exterior envelope 42 is then driven in rotation in the same first direction 1.

In parallel with the above, the bearing force applied by the user enables each gadroon 88 of the exterior envelope 42 to slide under the ramp 72 to arrive under the rim 77. This movement is made safe by the hard point 75 forming an obstacle to the free movement of the gadroon 88 under the ramp 72. The user thus obtains tactile feedback that indicate to them that the cap 16 is open. Arriving at the end of the ramp 72, the gadroons 88 cooperate with the rims 77 in order to retain the exterior envelope 42 on the interior envelope 44 in the axial direction (A).

In parallel with the above, the protuberance 86 of the exterior envelope 42 is moved away from the positioning edge 70 and then arrives on the guide slope 68, on which the radial part 862 of the protuberance 86 slides. Because of sliding on the guide slope 68, the exterior envelope 42 is moved in the axial direction (A) relative to the interior envelope 44. During this sliding, the prism 84, for its part, slides on the elastic lug 66. The exterior and interior envelopes 42, 44 therefore have a helicoidal movement relative to one another. The sliding of the protuberance 86 on the guide slope 68 continues until it reaches the end of travel abutment 69. The prism 84 then goes beyond the elastic lug 66 and is no longer in contact with it. The elastic lug 66 then returns to its original shape and locks the prism 84 via the locking face 67. In this way, the exterior envelope 42 is locked in rotation in this position relative to the interior envelope 44.

Figure 10:
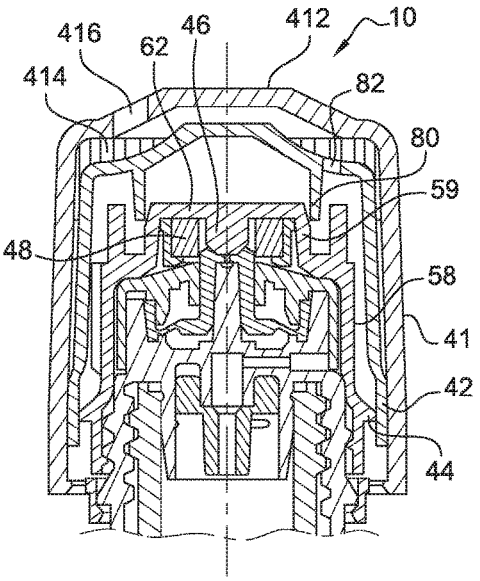
FIG. 10 is a sectional view of the nozzle from FIG. 1 in an unscrewing configuration.

The exterior envelope 42 is then moved away from the interior envelope 44 so that the sealing surface carried by the sealing skirt 80 is no longer in hermetically sealed contact with the sealing surface 60 carried by the second skirt 59, as can be seen in FIG. 10. It is therefore clear that after the first opening of the nozzle 10 the sealing surfaces are separated from one another. As the exterior and interior envelopes 42, 44 both include air passage orifices 62, 82, this enables a residual liquid evaporation path to be created between the opening 22 and the exterior of the nozzle 10 so as to allow air to pass via that path.

Once the exterior envelope 42 is locked in this position that is to say not in the storage configuration, it is constrained to move with the interior envelope 44. The exterior envelope 42 can drive the interior envelope 44 in rotation in both directions 1 and 2. It is clear that if the user continues the rotation movement of the cap 16 relative to the reservoir 12 in order to unscrew the cap 16 completely from the dispensing part 14, they break the frangible parts of the ring 74. This ring 74 therefore provides a simple way to verify that the nozzle 10 has not been opened previously.

According to an alternative to the frangible ring 74, or even combined therewith, the cap 16 may comprise other indicator means to indicate that the cap 16 is in a configuration other than the storage configuration, that is to say that the cap 16 has already been opened once. For example, the interior envelope 44 comprises two zones of different colour and the exterior envelope 42 comprises a slot intended to display one of the colour zones as a function of the configuration of the nozzle 10. The safety envelope 41 also comprises one or more slots enabling the colour displayed in the slot carried by the exterior envelope 42 to be viewed. The cap 16 according to this embodiment is particularly simple to manufacture. It is equally possible to combine the two embodiments to render the indication of opening of the cap 16 to the user simpler and more reliable.

Figure 11:
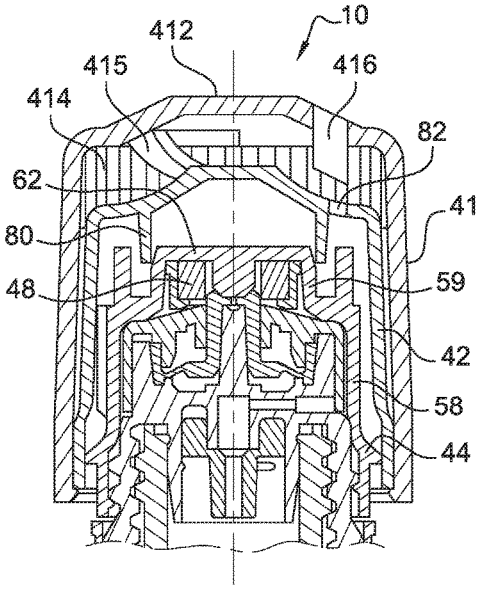
FIG. 11 is a sectional view of the nozzle from FIG. 1 in a safety configuration.

If thereafter the user, for example a child, merely turns the safety envelope 41 in the first direction 1, without pressing sufficiently strongly on the bottom 412, the cap 16 remains in the safety configuration. The flexible tongues 415 enable movement of the safety envelope 41 away from the exterior envelope 42 so that the drive means 414 are not able to come into contact with the complementary drive means 43, as can be seen in FIG. 11. The flexible tongue 415 slide on the bottom 412 whilst remaining slightly deformed. When the flexible tongues 415 arrive in the hollow detents 78 they expand without being immobilized in their movement. In this way, rotation of the safety envelope 41 in the first direction generates sliding of the flexible tongues 415 in each successive detent 78, so as to freewheel relative to the exterior envelope 42. In this safety configuration, the flexible tongues 415 are moved from one detent to another intermittently. The detents 78, being spaced from one another, therefore form a discontinuous cam path and the flexible tongues 415 passing over the cam path discontinuity generate a tactile or even audible indication.

Between two uses, the user screws the cap 16 back onto the dispensing part 14. To this end they press again on the safety envelope 41 and cause it to turn in a second direction 2, corresponding to the clockwise direction, without exerting a specific axial force. The drive means 414 mesh again with the complementary drive means 43. The safety envelope 41 and the exterior envelope 42 are therefore constrained to rotate together in the second direction 2 and the cap 16 can be screwed back on.

As seen above, after the first opening of the nozzle 10 the exterior envelope 42 is locked in the open position relative to the interior envelope 44 and can no longer return to the initial position. It is therefore clear that it is possible to go from the storage configuration of the nozzle 10 to the safety or unscrewing configuration but that the converse is not possible. It is therefore guaranteed that once the nozzle 10 has been used at least once the residual liquid evaporation path is always open.

In one embodiment, the cap 16 comprises a protuberance 46 (see in particular FIG. 8) intended to be in the immediate vicinity and to face the opening 22 when the cap 16 is mounted on the nozzle 10, that protuberance 46 having a shape 46 to expel the residual liquid, configured to evacuate the residual liquid to the outside when the cap 16 is mounted on the nozzle 10. The cap 16 may also comprise, instead of or combination with the above, a residual liquid absorbing pad 48 fixed to the cap 16 and more particularly to the interior envelope 44. In this example the pad 48 is of substantially annular shape and is disposed around the residual liquid expulsion shape 46. Examples of expulsion shape 46 and pad 48 and the mounting thereof in the cap 16 are described in more detail in the application WO2013/14069.

The cap 16 may have on the outside of the safety envelope 41, at the level of the bottom 76, raised or visual means indicating to the user how to go from the safety configuration to the unscrewing configuration. Those means may comprise a first arrow with the digit "1" indicating that the first step for opening the cap 16 is to depress the safety envelope 41 and a second arrow with the digit "2" indicating that the second step for opening the cap 16 is to turn the safety envelope 41 in the first direction 1.

The invention is not limited to the embodiments described. In particular, it will be clear that an absorbent pad may be provided on its own, without necessarily providing on the interior envelope 44 a protuberance having an expulsion shape 46. Moreover, it is clear that the structural shapes of the means described may readily vary whilst fulfilling functions such as those described.

What is claimed is:

1. A liquid dispensing nozzle, comprising:

a liquid dispensing opening, a removable cap designed to cover said opening when the cap is mounted on the nozzle, the cap comprising an exterior envelope and an interior envelope that are coaxial, mounted to be mobile relative to one another in an axial direction (A) of the nozzle and each have a sealing surface and are able to assume a before first use configuration, termed storage configuration, in which the sealing surfaces of the exterior envelope and the interior envelope are in hermetically sealed contact with one another, the cap further comprising a safety envelope mounted to be mobile relative to the exterior envelope between:

a configuration for unscrewing the cap when a bearing force exerted on the safety envelope has an intensity greater than a predetermined threshold, in which rotation in a first direction of the safety envelope drives rotation of the exterior envelope in the same first direction so as to be able to unscrew the cap;

a safety configuration when a bearing force exerted on the safety envelope has an intensity less than a predetermined threshold or when no bearing force is exerted on the safety envelope, in which the safety envelope is configured to freewheel relative to the exterior envelope in the first direction, the safety configuration further corresponding to a configuration, distinct from the storage configuration, in which the respective sealing surfaces of the exterior envelope and the interior envelope are separated from one another so as to allow air to pass between them.

2. The nozzle according to claim 1, wherein the safety envelope covers the exterior envelope entirely in the unscrewing configuration.

3. The nozzle according to claim 1, wherein the safety envelope comprises a bottom and a cylindrical wall that comprises an interior rim for retaining the exterior envelope inside the safety envelope, the interior rim being on an end of the cylindrical wall opposite the bottom and further comprising a protuberance projecting from the interior surface of the cylindrical wall.

4. The nozzle according to claim 1, wherein the safety envelope comprises drive elements intended to cooperate with complementary drive elements carried by the exterior envelope in order to drive the latter in rotation in the first direction in the unscrewing configuration.

5. The nozzle according to claim 4, wherein the drive elements comprise a plurality of projections arranged at the periphery of a cylindrical wall of the safety envelope and the complementary drive elements comprise a plurality of recesses, each projection being intended to come to bear against an recess in the unscrewing configuration.

6. The nozzle according to claim 5, wherein the safety envelope comprises a bottom, and wherein the cap comprises a return element between the safety envelope and the exterior envelope intended to inactivate the drive elements relative to the complementary drive elements when the cap is in the safety configuration, wherein the safety envelope comprises a bottom and the return element comprises a flexible tongue projecting from the interior surface of the bottom of the safety envelope.

7. The nozzle according to claim 5, wherein the drive elements and the complementary drive elements are configured so that the exterior envelope and the interior envelope are constrained to rotate together in a second direction opposite the first direction in order to screw on the cap.

8. The nozzle according to claim 1, wherein the cap comprises an indicator between the safety envelope and the exterior envelope configured to give the user tactile and/or sound feedback in the safety configuration, said indicator comprising the flexible tongue intended to pass over detents carried by the exterior envelope.

9. The nozzle according to claim 1, wherein there is a residual liquid evaporation path between the opening and the exterior of the nozzle, the residual liquid evaporation path being blocked in the storage configuration and open in the safety configuration and the unscrewing configuration.

10. The nozzle according to claim 1, wherein the interior envelope comprises first locking elements intended to cooperate with complementary first locking elements carried by the exterior envelope in order to hold the sealing surfaces apart.

11. The nozzle according to claim 1, wherein the cap comprises a residual liquid absorbing pad in the vicinity of the liquid dispensing opening.

12. The nozzle according to claim 1, wherein the cap comprises a protuberance intended to be in the immediate vicinity of and facing the opening when the cap is mounted on the nozzle, this protuberance having a shape for expelling the residual liquid configured to evacuate the residual liquid to the outside when the cap is mounted on the nozzle.

13. The nozzle according to claim 1, wherein the cap includes on the exterior of the safety envelope raised or visual elements indicating to the user how to go from the safety configuration to the unscrewing configuration.

14. The nozzle according to claim 1, wherein the cap comprises a slot in the safety envelope and in the exterior envelope enabling two zones of different color of the interior envelope to be seen for indicating that the cap is in a configuration other than the storage configuration.

15. The liquid dispensing device including a liquid dispensing nozzle mounted on a reservoir, comprising a nozzle according to claim 1.

16. The nozzle according to claim 2, wherein the safety envelope also covers the exterior envelope entirely in the storage and safety configurations.

* * * * *